United States Patent [19]

Allgood et al.

[11] Patent Number: 5,061,203

[45] Date of Patent: Oct. 29, 1991

[54] MAGNETIC BALLAST CONNECTOR SYSTEM

[75] Inventors: Christopher L. Allgood, Lewisville; Richard E. Hasz, Ramseur; Donald W. K. Hughes, Kernersville; Donald G. Stillie, Winston-Salem; Allan J. Sykora, Kernersville, all of N.C.

[73] Assignee: AMP Incorporated, Harrisburg, Pa.

[21] Appl. No.: 686,059

[22] Filed: Apr. 15, 1991

[51] Int. Cl.[5] ..... H01R 4/24

[52] U.S. Cl. ..... 439/441; 439/404

[58] Field of Search ..... 439/391–404, 439/417–419, 438–441

[56] References Cited

U.S. PATENT DOCUMENTS

| | | | |
|---|---|---|---|
| 3,496,522 | 2/1970 | Ellis et al. | 439/403 |
| 4,066,317 | 1/1978 | Bierfield et al. | 439/403 |
| 4,486,064 | 12/1984 | Long et al. | 439/402 |
| 4,952,169 | 8/1990 | Hayes, Sr. | 439/403 |

*Primary Examiner*—David L. Pirlot

*Attorney, Agent, or Firm*—Allan B. Osborne

[57] ABSTRACT

A connector system (10) for use with magnetic ballast is disclosed. The connector system (10) includes a mag wire carrier (12), attachable to the ballast and having anvils (24) for supporting magnet wires from the ballast coils. The system (10) further includes a connector (150) having terminals (14) with magnet wire terminating slots (56) for terminating wires on the anvils (24), a first terminating section (74) for terminating wires from electronic devices mounted on the ballast and a second terminating section (70) for terminating exit wires.

6 Claims, 6 Drawing Sheets

MAGNETIC BALLAST CONNECTOR SYSTEM

FIELD OF THE INVENTION

The invention disclosed herein relates to a connector system for use with the magnetic ballast of fluorescent lighting fixtures.

BACKGROUND OF THE INVENTION

The method of preparing the ballast for use in a fluorescent light fixture is very labor intensive and accordingly prone to error and substantial product waste. For example, in the assembly, magnet wires coming out of the ballast coils are twisted about contacts on a terminal board at one or both ends of the ballast and hand soldered to the contacts. The assembly is now tested for hi-pot, load and functional tests prior to the wax impregnation process. After wax impregnation of the coils, leads from the capacitors lead wires and thermal protector are hand soldered to the terminal board. Not surprisingly, a large number of ballast assemblies are rejected before installation in the ballast can for failure to pass electrical testing. Accordingly, it is now proposed to provide a connector system which does not require soldering and reduces the labor needed to assemble the ballast assembly.

SUMMARY OF THE INVENTION

According to the present invention, a connector system is provided having one component attachable to the ballast and having magnet wire supporting anvils and a mating connector comprising a housing with terminals in cavities therein. The terminals have wire termination slots for terminating the magnet wires, a first terminating section for terminating wires from electronic devices on the ballast and a second terminating section for terminating exit wires.

DESCRIPTION OF THE INVENTION

Figure 1:
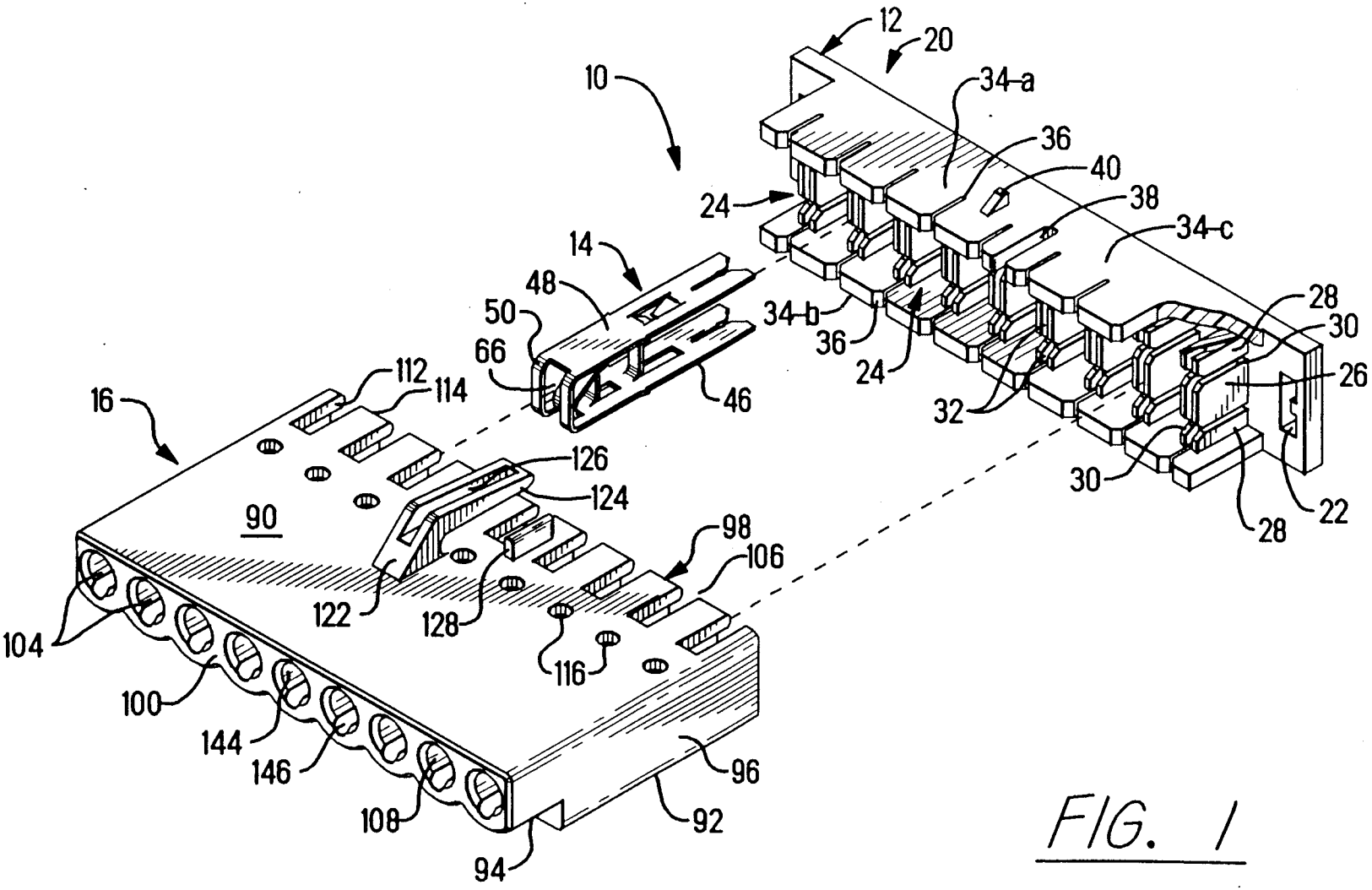
FIG. 1 is a view showing the three components comprising the connector system of the present invention.

Ballast connector system 10 as shown in FIG. 1 includes mag wire carrier 12, terminal 14 and housing 16. Mag wire carrier 12 and housing 16 are made from a suitable thermoplastic material. Terminal 14 is stamped and formed from a suitable conductive material such as brass or phos bronze.

Mag wire carrier 12 includes plate 20 having openings 22 at both ends. A plurality of side-by-side wire support walls or anvils 24 project outwardly from one surface of plate 20. Each anvil 24 includes center support wall 26 and outer support walls 28 on each side thereof with slots 30 therebetween. Wire receiving grooves 32 are provided on the free ends of walls 26, 28.

Bracketing walls 24 and normal thereto are elongated walls 34*a*, 34*b* (collectively walls 34) which are provided with slots 36 in alignment with grooves 32. In addition, keying slot 38 is provided in wall 34*a* and latch stud 40 is located on surfaces 34*c* of walls 34*a* (shown) and 34*b* (not shown).

Figure 2:
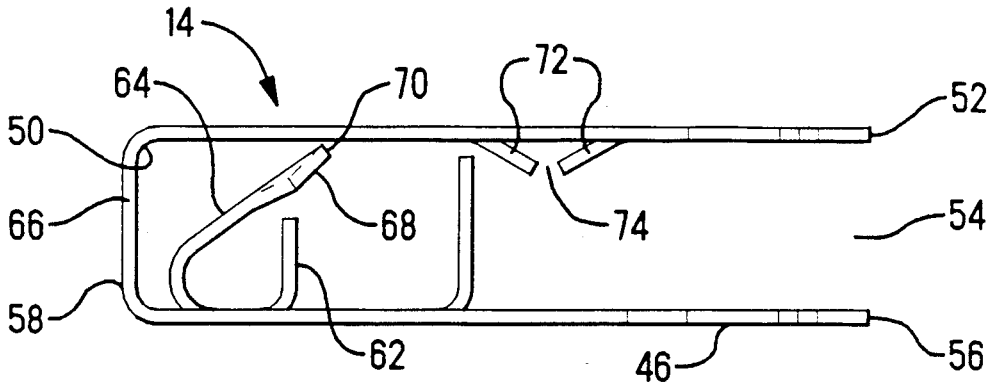
FIG. 2 is a side sectioned view of the terminal component.

With reference to FIGS. 1 and 2, terminal 14 is U-shaped with blades 46, 48 and bight 50 defining the "U". Free ends 52 of blades 46, 48 at the front end 54 of terminal 14 are slotted as indicated by reference numeral 56. Inwardly, wire stop 60, struck from blade 46, projects directly towards opposite blade 48. Between wire stop 60 and bight 50, anti-overstress arm 62, also struck from blade 46, projects inwardly towards wire terminating finger 64. Finger 64 is struck primarily from bight 50 and partly from blade 46 and is obliquely directed towards the front end 54. The striking of finger 64 from bight 50 provides opening 66. V-shaped slot 68 is provided in the free end of finger 64 to provide terminating section 70.

A pair of fingers 72, struck from blade 48, project obliquely inwardly with the free ends generally facing each other to form terminating section 74.

Figure 3:
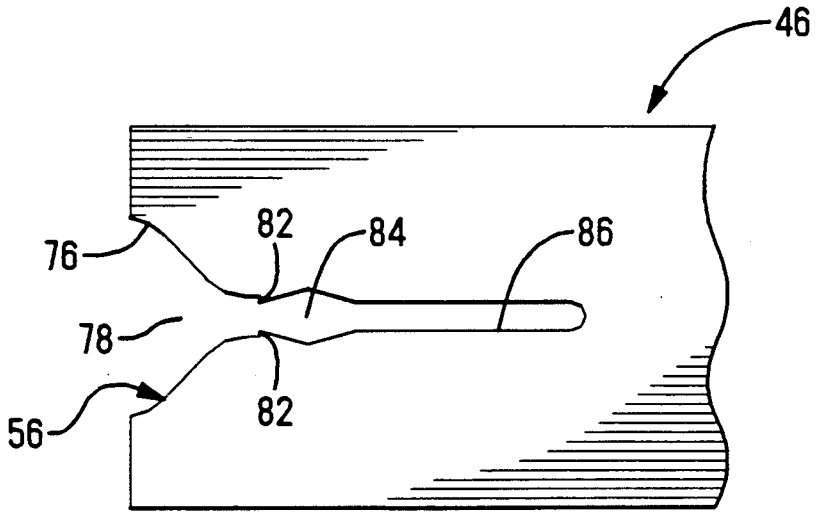
FIG. 3 shows the detail of the magnet wire terminating slot on the terminal blades.

FIG. 3 shows in larger scale a wire slot 56. Beveled edges 76 lead to constricted area 78 which is defined by facing points 82. Points 82 are formed by swaging which causes a localized enlarged are 84 inwardly therefrom. Narrow elongated slot portion 86 continues inwardly from the enlarged area 84.

With reference to FIG. 1 again, housing 16 is defined by top wall 90, base wall 92 having a stepped rear portion 94, side walls 96, front wall 98 and rear wall 100. Parallel cavities 104 extend through housing 16 with openings 106, 108 at front and rear walls 98, 100 respectively.

Notches 112 are cut into front edges 114 of top and base walls 90, 92 respectively with each notch 112 intersecting respective cavities 104.

Figure 4:
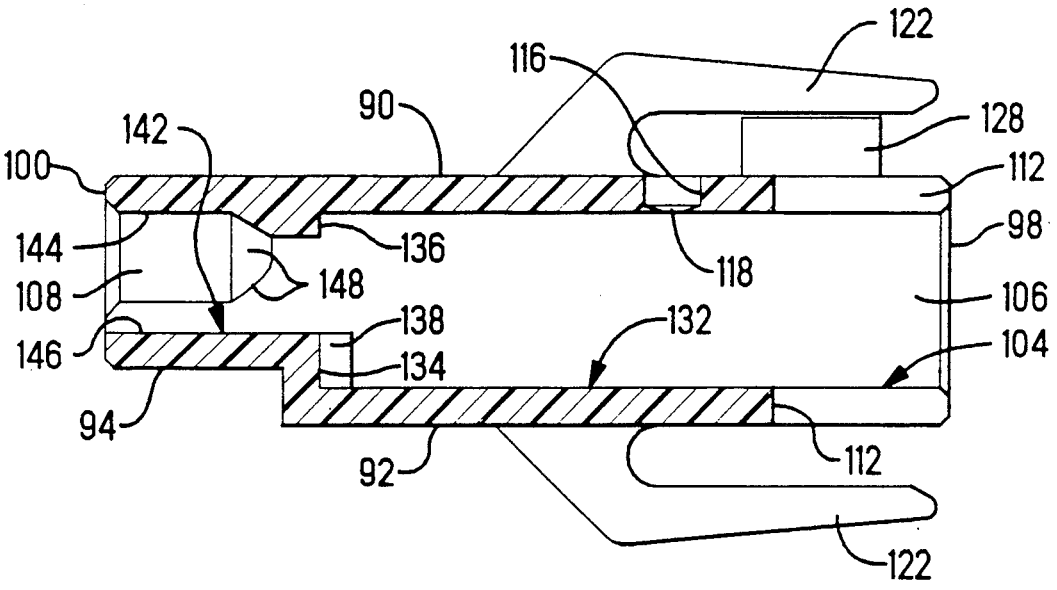
FIG. 4 is a side section view of a cavity in the housing component.

Directly behind each notch 112 on top wall 90 are holes 116 which are in line with but separated from respective cavities 104 by a thin membrane 118 as shown in FIG. 4.

Locking latch 122 on top and base walls 98, 100 respectively include a forwardly projecting resilient arm 124 having slot 126 therein. Next to latch 122 is an outwardly projecting key 128.

The structure of a cavity 104 is shown in FIG. 4. Front section 132 is rectangular with notches 112 intersecting it on two opposing sides. Hole 116, just behind notch 112 in top wall 90, is separated from section 132 by the aforementioned membrane 118. Forwardly facing shoulders 134, 136 define the rear end of section 132 with a narrow rib 138 jutting forwardly from the latter.

Rear section 142 of cavity 104 includes a circular portion 144 and release groove 146 parallel with and on one side thereof. Portion 144 narrows inwardly from rear opening 108 as indicated by the converging walls 148. The circular portion 144 and release groove 146 are also shown in FIG. 1.

Figure 5:
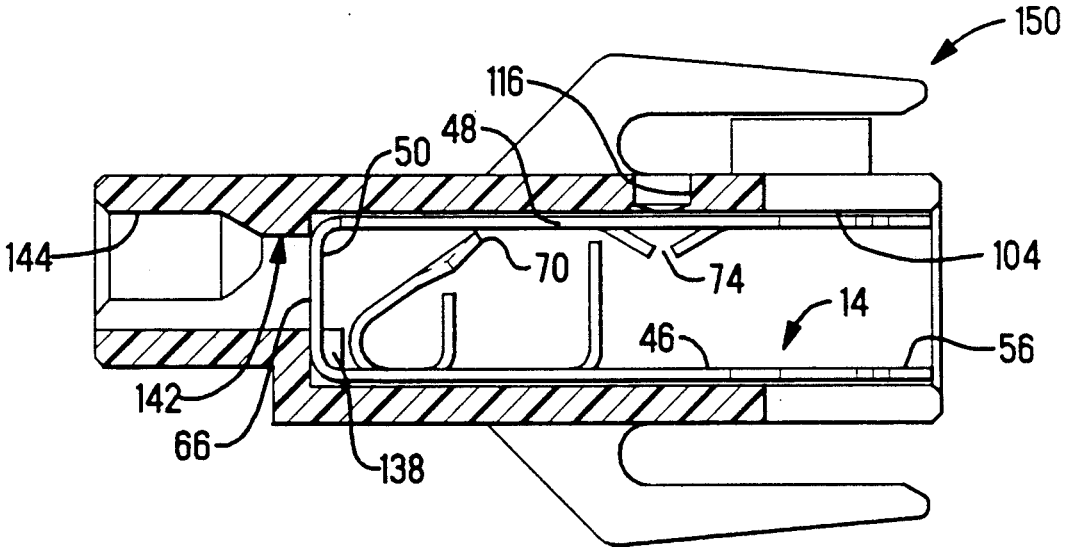
FIG. 5 is the FIG. 4 view showing a terminal in the cavity.

FIG. 5 shows a terminal 14 positioned in cavity 104. When properly inserted, rib 138 enters the lower part of opening 66 in bight 50, hole 116 is in alignment with terminating section 74 and circular portion 144 of rear section 142 is in line with the upper part of opening 66 and with terminating section 70. Blades 46, 48 are against opposing walls of front section 132 with slots 56 visible through notches 112.

Terminals 14 in housing 16 form connector 150 of connector system 10.

Figure 6:
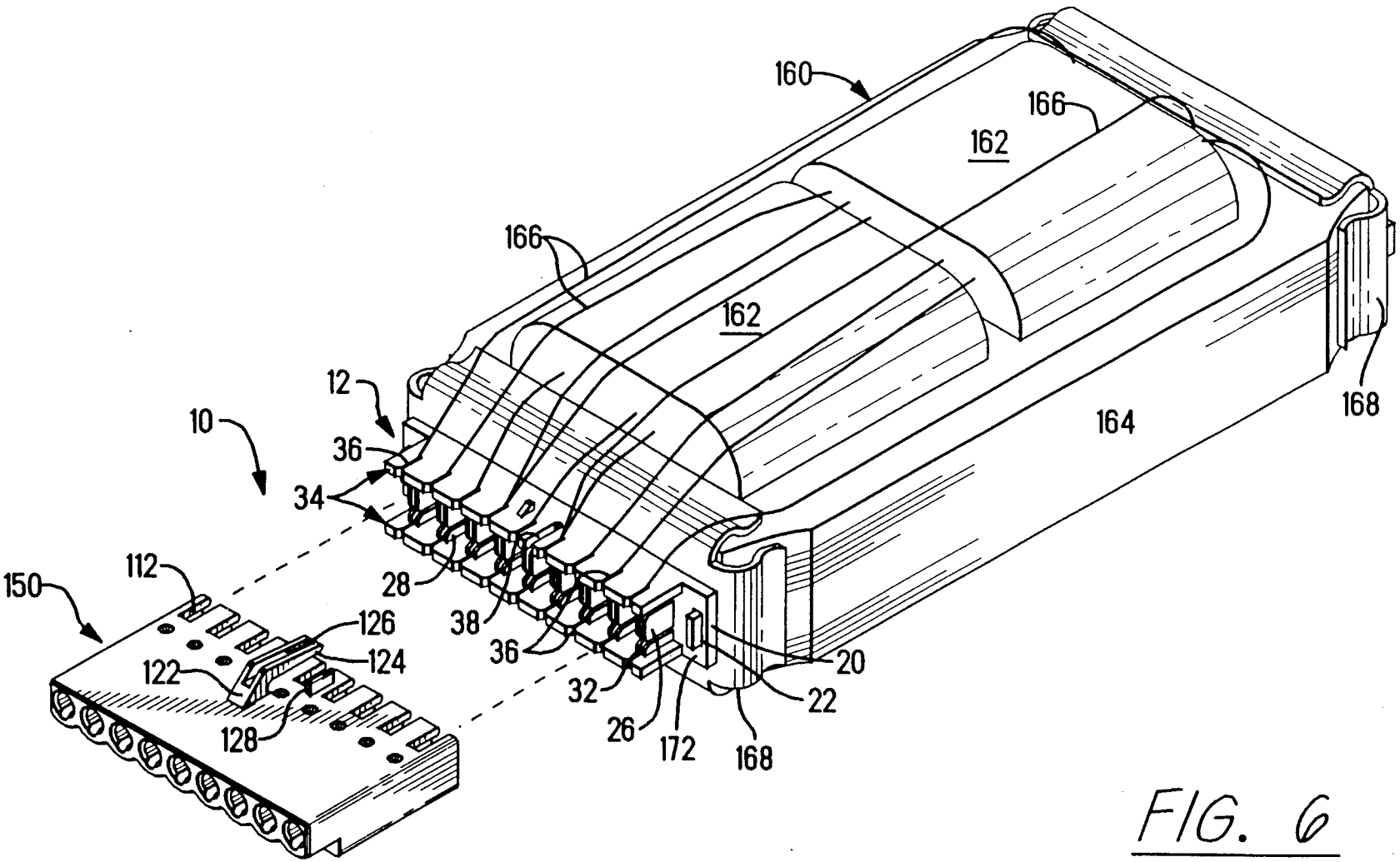
FIG. 6 shows the ballast with the magnet wires thereof dressed in the mag wire carrier component.

FIG. 6 shows ballast 160 for which connector system 10 was developed. Ballast 160 includes a pair of magnetic coils 162 and metallic laminates 164. Magnet wires 166 originate in coils 162 and are terminated in system 10. End clips 168 are attached at one or both ends and have studs 172 projecting outwardly adjacent the ends thereof.

Mag wire carrier 12 is attached to a spring clip 168 and magnet wires 166 are placed in grooves 32 on anvils 24 by being dressed through slots 36 in walls 34. Thereafter connector 150 is plugged into mag wire carrier 12 so that wire slots 56 (FIG. 3) on blades 46, 48 terminate magnet wires 166 thereto. Notches 112 straddle the outer support walls 28 of anvils 24 and blades 46, 48 are received in slots 30 between the two outer support walls 28 and the center support wall 26.

Incorrect mating is prevented by keying slot 38 and key 128. Latching of mag wire carrier 12 and connector 150 is provided by studs 40 entering slots 126 on arms 124 of latches 122.

Figure 7:
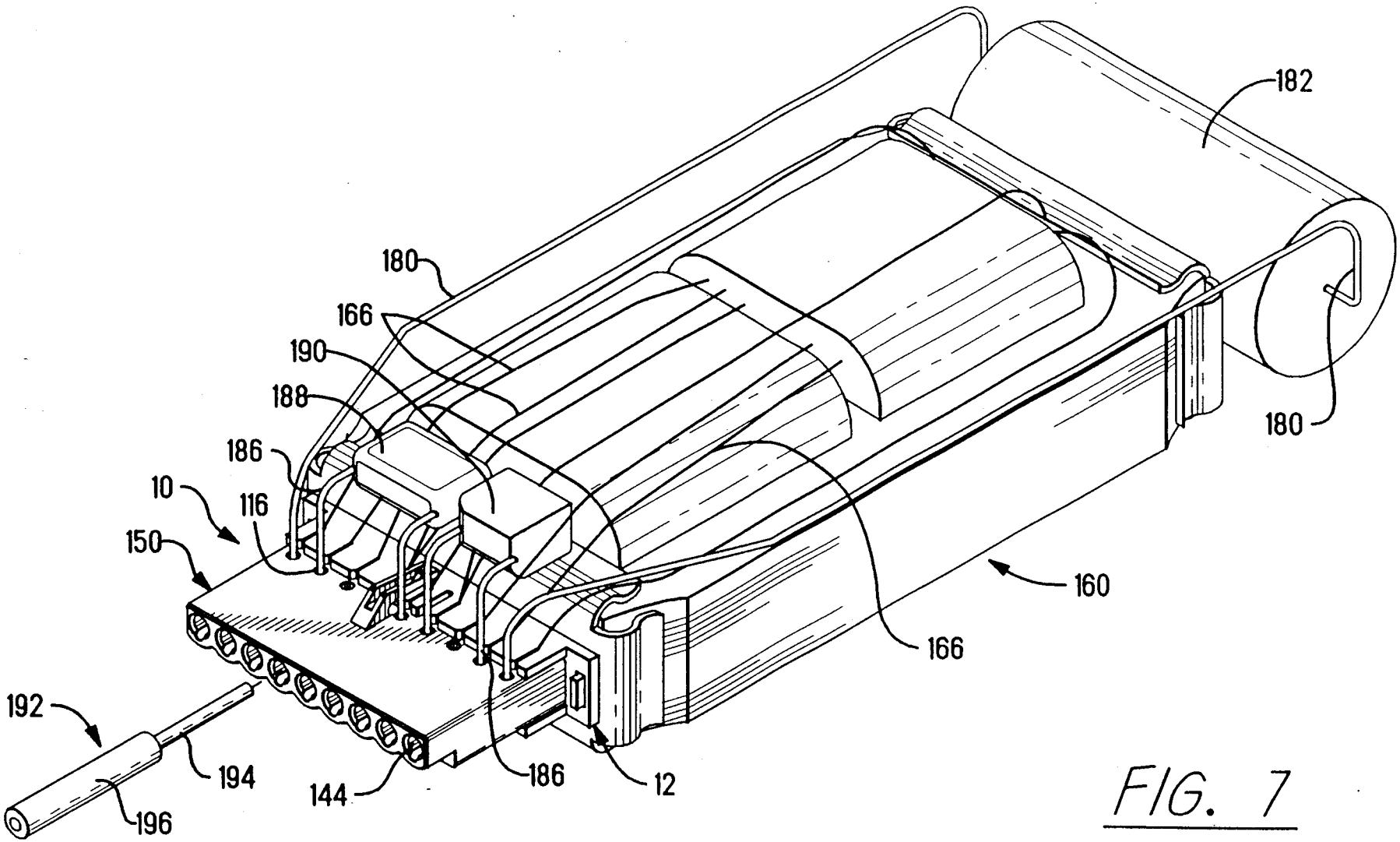
FIG. 7 shows the connector system in place on the ballast with the magnet wires and leads from other electrical devices terminated therein.

As shown in FIG. 7, leads 180 from capacitor 182 are terminated to terminating section 74 (FIG. 2) in the appropriate terminals 14 by being pushed through membranes 118 in holes 116 and in between fingers 72. Similarly, leads 186 from thermal protector 188 and capacitor 190 are terminated to terminating sections 74 in the appropriate terminals 14.

Exit wires 192 (only one shown) are terminated in terminating section 70 by conductor 194 being pushed through opening 66 in bight 50 and between slot 68 in finger 64 (FIG. 2) and blade 48. Wire stop 60 keeps conductor 194 from interfering with terminating section 74 and arm 62 prevents finger 64 from being over stressed. Insulation jacket 196 is received in circular portion 144 of the rear section 142 of cavity 104. Wires 192 may be removed from connector 150 by inserting a small shaft (not shown) through release groove 146 and opening 66 and pressing finger 68 down away from blade 48.

Figure 8:
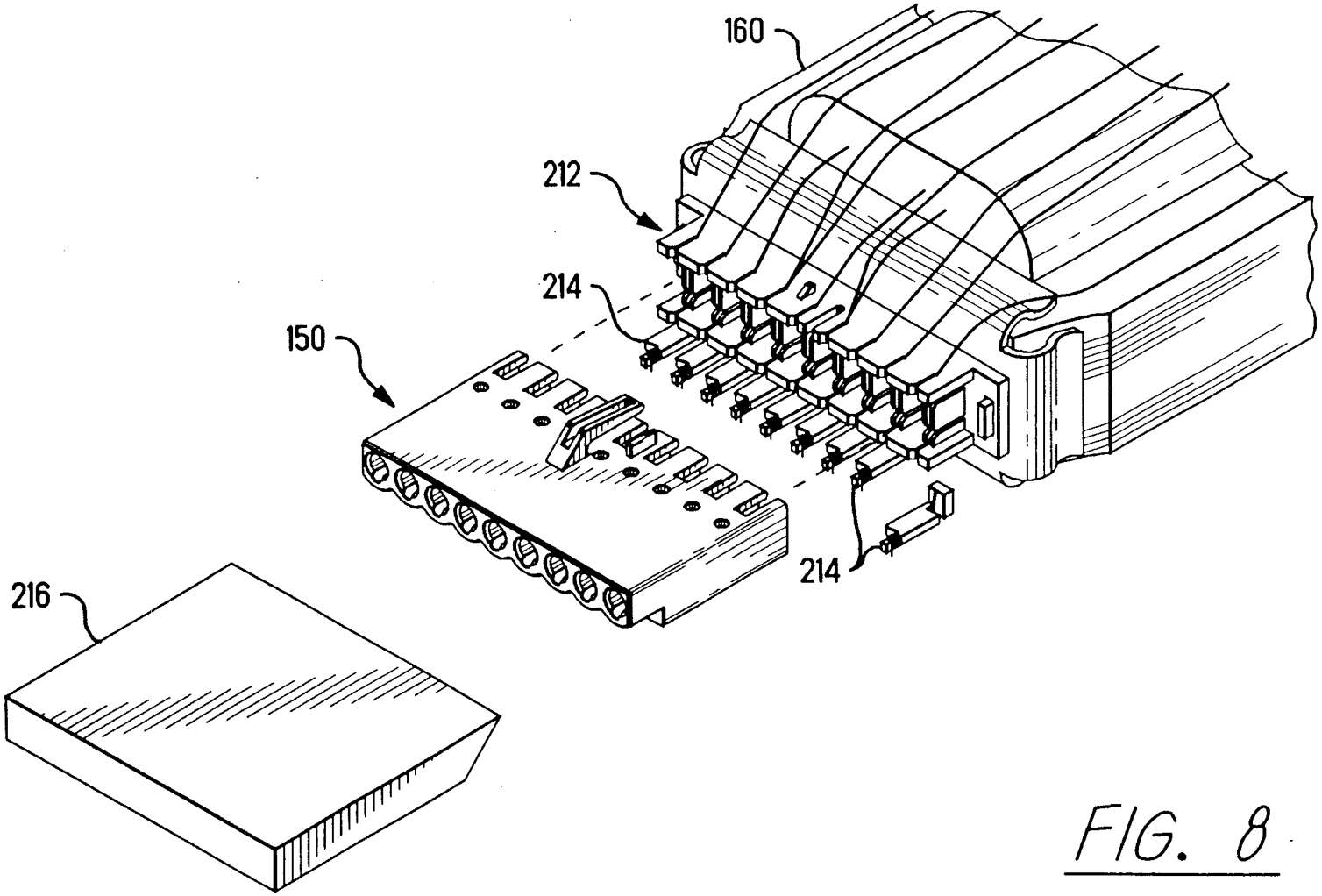
FIG. 8 shows the mag wire carrier component with magnet wire bobbins thereon.

FIG. 8 shows mag wire carrier 212 which is another embodiment of mag wire carrier 12. Mag wire carrier 212 includes integrally molded bobbins 214 attached to comb **34*b*. The wires 166, after being dressed across anvils 24 are held in place by being wrapped around bobbins 214. Prior to connector 150 being plugged into mag wire carrier 212, cutter 216 severs bobbins 214 and the ends of wires 166 wrapped therearound from wall 34*b***.

As can be discerned from the foregoing, a connector system for use with magnetic ballasts has been described. The connector system includes a mag wire carrier for being attached to the ballast and having anvils across which the ballast magnet wires are laid. The system further includes a connector having terminals with magnet wire terminating slots, a terminating section where leads from other ballast components can be terminated and another terminating section for terminating wires which exit the ballast assembly. The connector plugs into the mag wire carrier to terminate the magnet wires and provide an electrical path to the exit wires.

Of the several advantages of the present invention, one particularly important feature is that the disclosed means for terminating the wires eliminates the need for soldering and the labor associated with it. Further, probe testing of the final assembly can be done in a single operation instead of the multiple checks required in the present, labor intensive method. Another important feature is that the disclosed connector system will withstand the asphalt, tar, sand potting mixture without leakage into the termination areas.

We claim:

1. A connector system for use with a magnet ballast having a plurality of coil wires, said system comprising:

a dielectric first component having a plurality of side-by-side wires support means and being adapted to be attached to a ballast and receive coil wires on said support means;

a dielectric second component mateable with said first component and having a plurality of side-by-side cavities which are open at opposite ends and a plurality of holes normal to and intersecting respective said cavities intermediate said ends; and a plurality of conductive terminals having a wire terminating slot at one end, a first wire terminating section at another end and a second wire terminating section intermediate said ends, said terminals disposed in respective said cavities with said wire terminating slot at one open end to reveive and terminate a wire on said support means when said first and second components are mated and with said first wire terminating section accessible through said hole and with said second wire terminating section accessible through the other open end.

2. The connector system of claim 1 wherein said wire support means include an outwardly projecting first wall with a wire receiving groove along a free end thereof.

3. The connector system of claim 2 wherein said wire support means further include outwardly projecting second and third walls, one on each side of and spaced from said first wall.

4. The connector system of claim 3 wherein said first component further includes a pair of elongated walls, one on each side of and normal to said wire support means and having slots therein parallel to and in alignment with said wire receiving groove.

5. The connector system of claim 4 wherein said terminal is U-shaped with parallel, spaced apart, flat blades having wire terminating slots at free ends thereof and an opening through a bight extending between and joining said blades, said blades adapted to be inserted between said first wall and respective second and third walls in said first component.

6. A connector system for use with a ballast having magnet wires therewith, said system comprising:

a component to be attached to a ballast and having outwardly projecting, magnet wire support walls thereon and on each side of said support walls an elongated wire dressing wall having slots in registration with said support walls;

a connector mateable with said component and comprising a housing with cavities therethrough and holes normal to and intersecting respective said cavities and terminals positioned in respective said cavities, said terminals having wire terminating slots at one end for receiving and terminating wires on said wire support walls when said connector mates with said component, said terminals further having a first terminating section for terminating wires inserted through said holes and a second terminating section for terminating wires inserted through openings in said cavities.

* * * * *